US008393109B2

(12) United States Patent
Gilmore

(10) Patent No.: US 8,393,109 B2
(45) Date of Patent: Mar. 12, 2013

(54) COMBINATION RED DOT SIGHT AND RANGE INDICATOR APPARATUS

(75) Inventor: W. Riley Gilmore, Tulsa, OK (US)

(73) Assignee: Gilmore Sports Concepts, Inc., Tulsa, OK (US)

( * ) Notice: Subject to any disclaimer, the term of this patent is extended or adjusted under 35 U.S.C. 154(b) by 0 days.

(21) Appl. No.: 11/446,862

(22) Filed: Jun. 5, 2006

(65) Prior Publication Data

US 2007/0068018 A1 Mar. 29, 2007

Related U.S. Application Data

(60) Provisional application No. 60/687,501, filed on Jun. 3, 2005.

(51) Int. Cl.
*F41G 1/473* (2006.01)

(52) U.S. Cl. ..... 42/113; 42/142; 356/247; 33/284

(58) Field of Classification Search ..... 42/113, 42/114, 115, 116, 117, 142; 356/247; 89/200; 33/227, 284

See application file for complete search history.

(56) References Cited

U.S. PATENT DOCUMENTS 5,033,219 A * 7/1991 Johnson et al. ..... 42/115
5,052,801 A * 10/1991 Downes et al. ..... 356/153
5,205,044 A * 4/1993 DePaoli ..... 42/132
5,373,644 A * 12/1994 DePaoli ..... 42/113
5,491,546 A * 2/1996 Wascher et al. ..... 356/4.03
5,555,662 A * 9/1996 Teetzel ..... 42/115
5,615,004 A 3/1997 Nourrcier
5,623,335 A 4/1997 Bamberger
D390,856 S 2/1998 Imahashi
5,767,953 A 6/1998 McEwan
5,801,818 A 9/1998 Corrigan et al.
5,831,718 A 11/1998 Desai et al.
6,023,322 A 2/2000 Bamberger
6,061,919 A 5/2000 Reichert
D427,275 S 6/2000 Gilmore
6,079,111 A 6/2000 Williams et al.
6,157,591 A 12/2000 Krantz
6,199,286 B1 * 3/2001 Reed et al. ..... 33/265
6,226,077 B1 5/2001 Dunne
6,252,706 B1 * 6/2001 Kaladgew ..... 359/399
6,269,581 B1 8/2001 Groh
6,327,806 B1 * 12/2001 Paige ..... 42/113
6,331,887 B1 12/2001 Shiraishi et al.
6,363,648 B1 * 4/2002 Kranich et al. ..... 42/117

(Continued)

OTHER PUBLICATIONS

Unknown, Laser Range Finder , , Publisher: Aselsan Microelectronics at www.aselsan.com.

(Continued)

*Primary Examiner* — Benjamin P Lee
(74) *Attorney, Agent, or Firm* — Fellers, Snider, Blankenship, Bailey & Tippens, P.C.

(57) ABSTRACT

A combination red dot sight (reflex sight) and electronic range indicator displayed in a sighting element. The sighting element is housed in a body which includes lens elements and a light source for the red dot sight as well as an optical display for the range indicator. A processor for the red dot sight and the range indicator are housed in a frame. A user interface includes indicia for varying the intensity of the light source for the red dot sight as well as activate the range indicator. Alternately, the range indicator may be activated by a button positioned remotely, such as on the firearm or bow and may be wired to the range indicator circuit or communicate via wireless transmission. An emitting lens and a receiving lens are optically connected via a range finding circuit to the processor.

15 Claims, 4 Drawing Sheets

U.S. PATENT DOCUMENTS

| | | | | |
|---|---|---|---|---|
| 6,452,666 | B1 | 9/2002 | Barna et al. | |
| 6,501,539 | B2 | 12/2002 | Chien et al. | |
| 6,556,785 | B2 | 4/2003 | Nonaka et al. | |
| 6,583,860 | B2 | 6/2003 | Haga | |
| 6,583,862 | B1 * | 6/2003 | Perger | 356/4.01 |
| 6,603,534 | B2 | 8/2003 | Seifert et al. | |
| 6,615,531 | B1 | 9/2003 | Holmberg | |
| 6,636,296 | B1 | 10/2003 | Faulkner et al. | |
| 6,661,500 | B1 | 12/2003 | Kindt et al. | |
| 6,704,507 | B2 | 3/2004 | Nakano et al. | |
| 6,781,677 | B1 | 8/2004 | Muenter et al. | |
| 6,839,127 | B1 | 1/2005 | Anderson | |
| 6,862,084 | B2 | 3/2005 | Nagata et al. | |
| 6,868,614 | B2 | 3/2005 | Floied et al. | |
| 6,988,331 | B2 * | 1/2006 | Holmberg | 42/142 |
| 7,069,685 | B2 * | 7/2006 | Houde-Walter | 42/132 |
| 7,225,578 | B2 * | 6/2007 | Tai | 42/132 |
| 7,234,265 | B1 * | 6/2007 | Cheng et al. | 42/113 |
| 2004/0068912 | A1 * | 4/2004 | Renntoft | 42/114 |
| 2005/0252062 | A1 * | 11/2005 | Scrogin et al. | 42/119 |
| 2006/0164718 | A1 * | 7/2006 | Tai | 359/353 |
| 2006/0187409 | A1 * | 8/2006 | Hull | 351/159 |
| 2006/0254116 | A1 * | 11/2006 | Holmberg | 42/142 |
| 2008/0060248 | A1 * | 3/2008 | Pine et al. | 42/114 |

OTHER PUBLICATIONS

Lowery et al., Design and Simulation of a Simple Laser Rangefinder Using a Semiconductor Optical Amplifier-Detector, Optics Express, May 16, 2005, pp. 3647-3652, vol. 13, No. 10, Publisher: Optical Society of America.

Bartolini et al., Development of a Laser Range Finder for the Antarctic Plateau, EARSeL eProceedings No. 1, Jun. 16, 2000, Publisher: Proceedings of EARSeL-SIG-Workshop LIDAR.

Dreyer, Facts and Figures About Dot Sights, Encyclopedia of Bullseye Pistol, Jun. 1, 2005, Publisher: www.bullseyepistol.com.

Unknown, How to Buy a Laser Rangefinder, Jun. 1, 2005, Publisher: www.opticsplanet.com.

* cited by examiner

COMBINATION RED DOT SIGHT AND RANGE INDICATOR APPARATUS

CROSS REFERENCE TO RELATED APPLICATION

This application claims the benefit of U.S. Provisional Patent Application Ser. No. 60/687,501 entitled "COMBINATION RED DOT SIGHT AND RANGE FINDER APPARATUS" filed Jun. 3, 2005.

FIELD OF THE INVENTION

This invention relates generally to sighting devices for bows and firearms.

BACKGROUND OF THE INVENTION

The use of sighting devices by hunters and marksmen has been known for centuries. Hunters and marksmen have long used sighting devices in order to accurately direct a projectile from a bow, pistol, rifle, or shotgun. Such sighting devices have evolved from simple mechanical devices which were aligned to the target to optical scopes with precision lenses and laser pointing devices.

A reflex sight (or red dot sight) is a sighting device which can be affixed to a bow, pistol, rifle, or shotgun, to assist in aligning the projectile with the intended target. In such devices, a dot of light, (traditionally red but other colors such as green are also available) is projected from a light sources (such as an LED) to a lens which is visible to the shooter who aligns the dot on the intended target. The dot is calibrated such that its alignment with the target also aligns the projected to the intended target. Such devices are commonly adjustable for distance (range), windage, and intensity (to accommodate various light conditions). However, as it is apparent, in order to adjust the sighting device for the proper range, one must first know the actual range to the target.

In order to determine range, many different types of range finding devices are known in the art. The presently most accurate type of devices are the electronic range finding devices. Electronic range finding devices produce a signal, most commonly a very fast pulse of laser light, directed at the target. A portion of the signal is reflected back toward the device which is then directed toward a receiving lens and a receiver. Microprocessor technology containing a high speed clock is used to calculate the distance (range) by measuring the time required for each pulse to travel from the device and back to the receiver.

At present, both the described sighting devices and range finding devices are separate units which must each be carried by the hunter/marksman. In other words, hunters and marksmen using a red dot sight (reflex sight) on their bows, pistols, rifles, or shotguns must also use another device for range finding to gauge the distance to their intended target. In the case of most hunting situations, when time is spent determining the distance to the game with one device and then additional time spent getting ready with the bow or firearm, often the game has moved thus negating the advantage of knowing the target's distance. A need, therefore, exists for an inclusive combination device which includes a red dot sight and an electronic range finding device in one unit.

SUMMARY OF THE INVENTION

The present invention includes a combination of a red dot sight (reflex sight) and range finding (or indicator) apparatus.

The present invention combines a range indicator with a red dot sight in a single sighting element. A range indicator display is optically visible to the user in the same sighting element as the red dot sight. In this way, the user does not have to divert his or her line of sight from the red dot sight in order to obtain the range to the target and vice versa. The present invention further combines an electronic range finding device and the red dot sighting device into a single unit which is capable of mounting on a bow, pistol, rifle, or shotgun. By having a combination red dot sight and electronic range indicator apparatus in a single unit, a hunter or marksman can quickly determine the distance (range) to the target and make an accurate shot thereto. In one preferred embodiment, the magnification of the sight is relatively low (such as 1×) such that the user can leave both eyes open while using the sight and thus maintain normal depth perception. For purposes of the present invention the term "bioptic" describes a sight or scope which allows the user to leave both eyes open to maintain normal depth perception and full field of view while using the sight.

The combination sighting device of the present invention could have a single rectical (red dot aiming point) or multiple changeable recticals and could have the distance to target displayed within the sight or displayed externally. The electronic range finder function could be activated in the combination of the present invention with a push button located on the body of the combination device or have an external push button which could be either connected to the combination device via a cord or via a remote operation such that the push button could be attached to the bow, pistol, rifle, or shotgun in any convenient location.

Accordingly, it is an object of the present invention to provide a combination of a red dot sight for sighting a target in an apparatus for determining the range to the target in a single unit. Other objects would be apparent from the attached drawings, the specification and the claims.

DESCRIPTION OF THE PREFERRED EMBODIMENTS

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1:
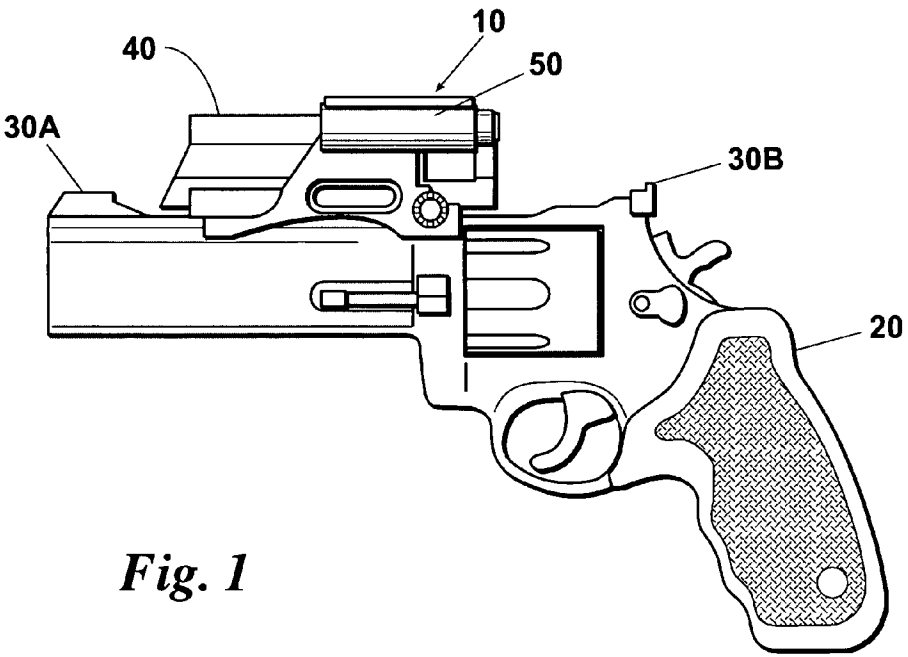
FIG. 1 depicts a preferred embodiment of the combination electronic range finder apparatus and red dot sight of the present invention affixed to a pistol.

The present invention relates to a combination of an electronic range finding device and a red dot sight (reflex sight) in one unit. FIG. 1 depicts the combination electronic range finding and red dot sighting device 10 affixed to a pistol 20. As shown, combined electronic range finding and red dot sighting device 10 is affixed to pistol 20 in lieu of the stock sight 30A and 30B so that the shooter can look through device 10 in a normal manner.

Combination electronic range finding device and red dot sighting device 10 includes a body 40 and a frame 50. The optics for device 10 are housed within body 40 and the electronics within frame 50 (with the exception of an emitting lens described below). Frame 50 is mounted to pistol 20 in a known manner.

Figure 2:
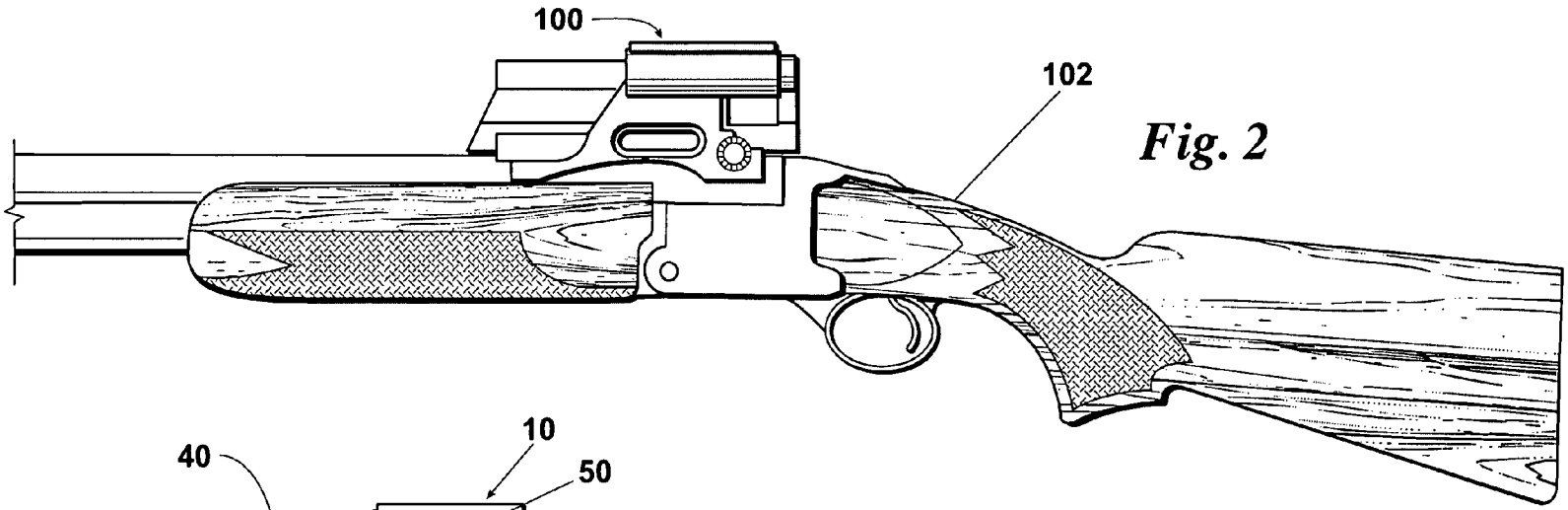
FIG. 2 depicts a preferred embodiment of the combination electronic range finder apparatus and red dot sight of the present invention affixed to a shotgun.

FIG. 2 depicts an alternate embodiment combination electronic range finder and red dot sight 100 mounted to a shotgun 102. The device of the present invention may also be mounted on a rifle or a bow (not shown).

Figure 3:
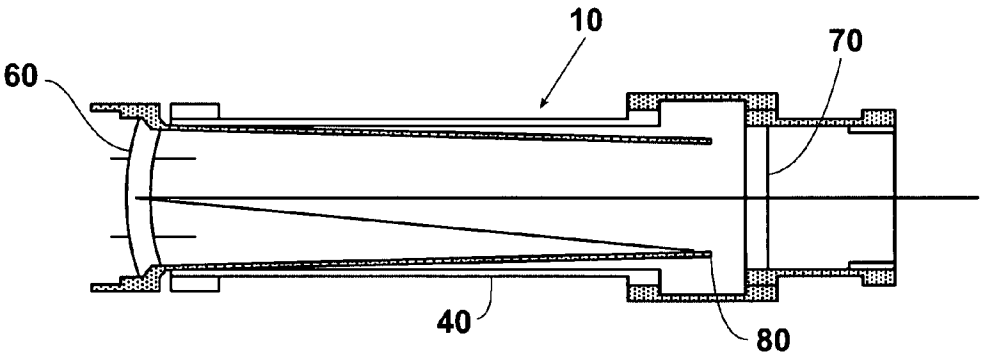
FIG. 3 is a partial side view of the combination red dot sight and electronic range finder apparatus of the present invention illustrating the red dot sight function.
Figure 6:
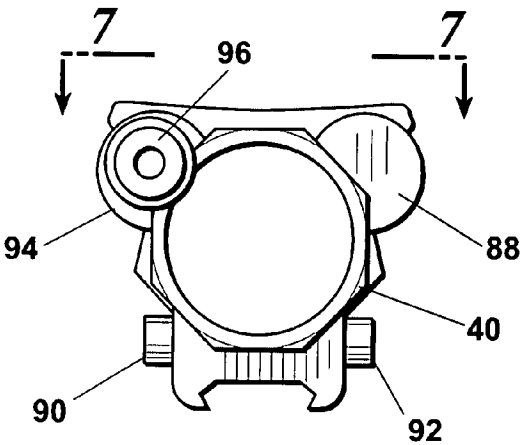
FIG. 6 is a rear view of the combination red dot sight and electronic range finder.

The red dot sight apparatus of combination device 10 shall next be described. FIG. 3 is a partial cutaway view depicting body 40 of combination device 10 (of FIG. 1) for the purpose of illustrating the red dot sighting device. Body 40 comprises, generally a cylindrical tube which houses lenses 60 and 70 and a light source 80. Light source 80 in the preferred embodiment is a light emitting diode which emits a red light that is projected toward concave lens 60. Lens 60 includes a thin metallic coating that reflects red light but transmits other colors freely therethrough. In operation, the red light emitted from light source 80 is reflected by lens 60 and directed back toward the shooter's eye through lens 70. To the shooter, the dot appears to be projected upon the target and is calibrated so as to be aligned with the direction of the projectile directed toward the target. This alignment can be adjusted for elevation and windage by moving the body horizontally or vertically. This adjustment may be performed either manually with screws applied to coil springs in a known manner, or electronically, by the use of adjustments 90 for windage and 92 for elevation (FIG. 6). The combination device of the present invention could have a single rectical (red dot/aiming point) or multiple changeable recticals. Further, the elevation alignment may occur automatically based on the range provided by the range finder.

The distance between lens 60 and lens 70 can be adjusted so as to account for eyesight imperfections of the shooter in order to provide an accurate sighting device. It should also be understood that the light source could be any other acceptable color, such as green and it is not limited to the red described above with regard to the preferred embodiment. However, it is understood that the coating on lens 60 would have to be changed to accommodate the color of light emitted from the light source.

Figure 5:
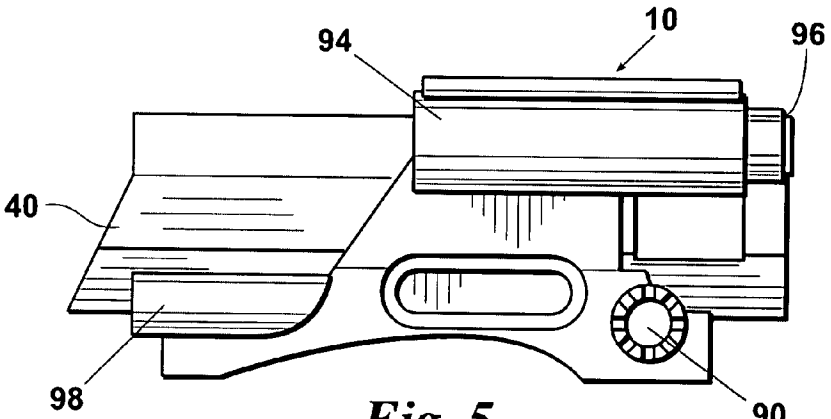
FIG. 5 is a side view of the combination red dot sight and electronic range finder.
Figure 8:
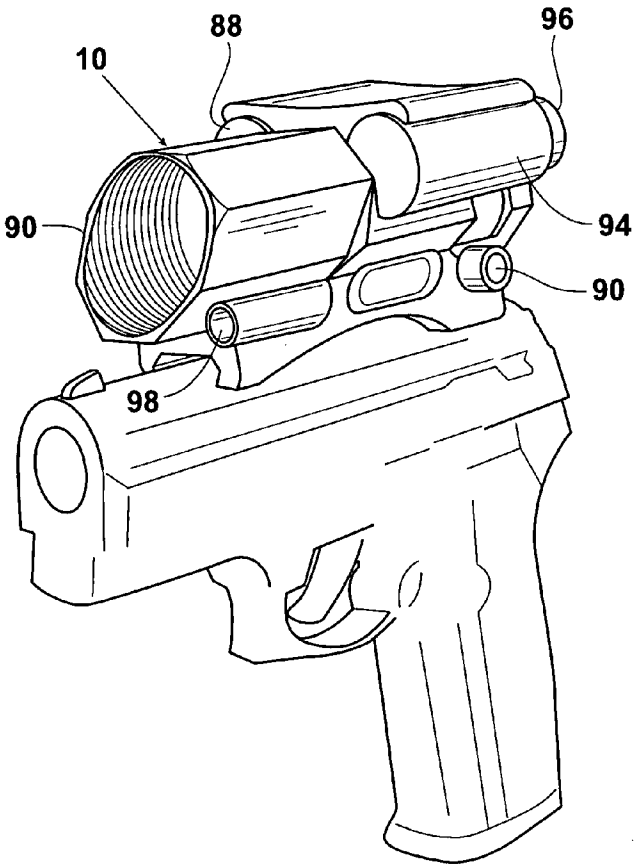
FIG. 8 provides a perspective view of the combination red dot sight and electronic range finder attached to a pistol.

With reference to FIGS. 5, 6, and 8, sight/range finder combination 10 further includes a battery holder 94 having a removable battery cover 96 for housing a battery to supply electrical power for operation of the device. In one preferred embodiment, tube 88 houses a detector 226 (FIG. 9) for the range finding circuit (as discussed in more detail hereinbelow) and tube 98 houses the corresponding emitter 224. It should be noted that the roles may be reversed, i.e. tube 88 housing the emitter and tube 98 housing the detector or one, or both, of the emitter and detector may be housed within the body 40 of sight 10.

Figure 10:
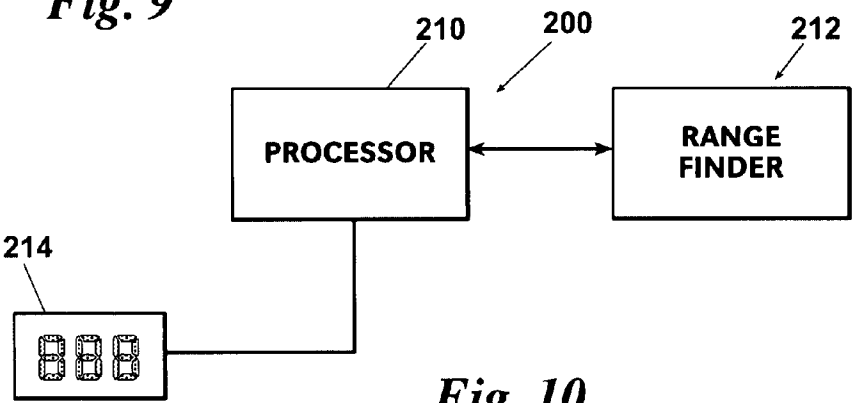
FIG. 10 is a block diagram of a preferred embodiment of the circuitry employed in the sight of FIG. 7.

The electronic range finding aspect of the combination device of the present invention shall next be described. Turning to FIG. 10, a preferred embodiment of an electronic range finder 200 includes: a processor 210; a range finding circuit 212; and a display 214. For the purposes of the present invention, the term "processor" is to be broadly construed to include any circuitry which is capable of coordinating the functions of the range finder circuit 212, the display 214, and the user interface 260 (FIG. 7) which is described in more detail hereinbelow. By way of example and not limitation, a processor may comprise a microprocessor, microcontroller, programmable gate array, field programmable gate array, ASIC semiconductor, or even discrete logic.

Figure 9:
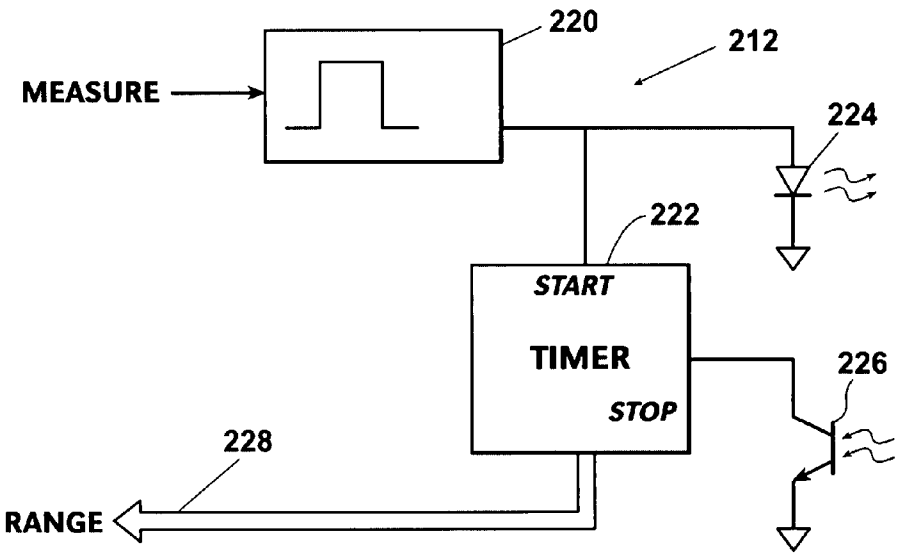
FIG. 9 is a block diagram of a preferred embodiment of a range finder as used on the sight of FIG. 7.

With further reference to FIG. 9, a preferred embodiment of range finder 212 includes: a pulse generator or trigger 220; a timer 222 which is initiated by pulse generator 220; a laser, or LED, emitter 224 which generates a pulse of light corresponding to the output of pulse generator 220; a phototransistor, photodiode, or like device, 226 which receives the pulse of light after it is reflected off of a target; and output 228. When a reflected pulse is received at detector 226, timer 222 is stopped. The time measured at timer 222 is representative of the distance between the range finder and the target. By way of example and not limitation, since light travels at roughly 300 million meters per second, if timer 222 is counts at a rate of 150 MHz, each count is roughly equal to one meter (in light of the fact that the pulse of light must traverse the distance twice for the round trip). Upon receipt of the reflected pulse, the count is presented at output 228 for use by processor 210. As will be apparent to those skilled in the art, delay may be introduced by emitter 224, detector 226, and even by timer 222. If such delays create objectionable error, the delay may be subtracted from the time determined by timer 222 either within timer 222, within processor 210, or even within display 214.

Figure 4:
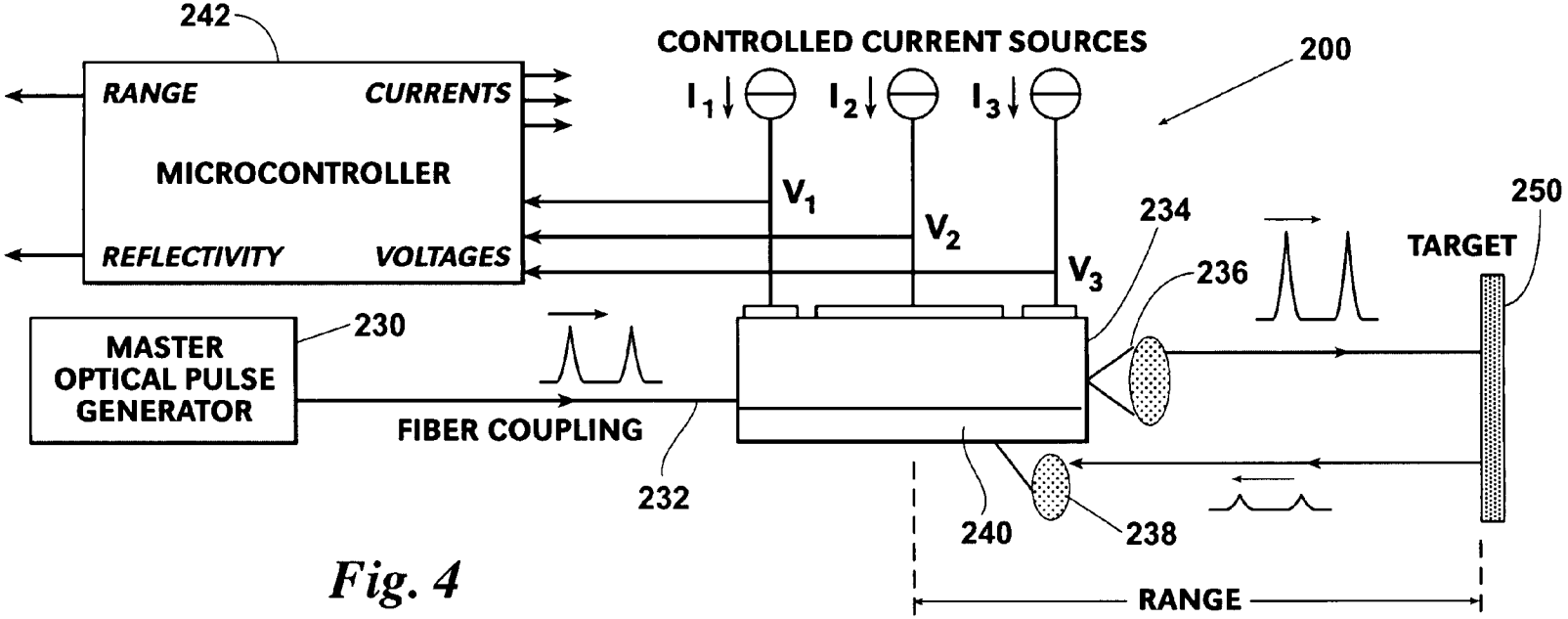
FIG. 4 is an electrical diagram depicting one preferred embodiment of the electronic range finder device of the combination red dot sight and electronic range finder apparatus of the present invention.

With further reference to FIG. 4, by way of further example and not by way of limitation, a more specific circuit diagram for the electronic range finding feature 200 is depicted.

As shown, an optical pulse generator 230 produces a pulse of laser light which is carried through fiber coupling 232 to an emitter 234. The pulse of laser light is produced from emitter 234 through a lens 236 and directed toward a target 250. A portion of the pulse is reflected from the target back to a lens 238 and a receiver 240. In the device of the preferred embodiment of FIG. 1, lens 238 is the same lens as concave lens 60 described above and depicted in FIG. 3 while lens 240 is positioned within frame 50 beneath body 40.

Once the pulse is received by the receiver, microcontroller 242 calculates the distance to the target through the use of a high speed clock contained therein by measuring the time taken for the pulse to travel from the emitter to the target and back to the receiver.

Pulses of laser light produced from the electronic range finding unit may be continuously produced in a repetitive manner. However, in the preferred embodiment, in order to preserve significant power in the power supply which powers the device, the pulse is selectively emitted by the shooter through the use of a push button as part of the user interface of FIG. 7.

Figure 7:
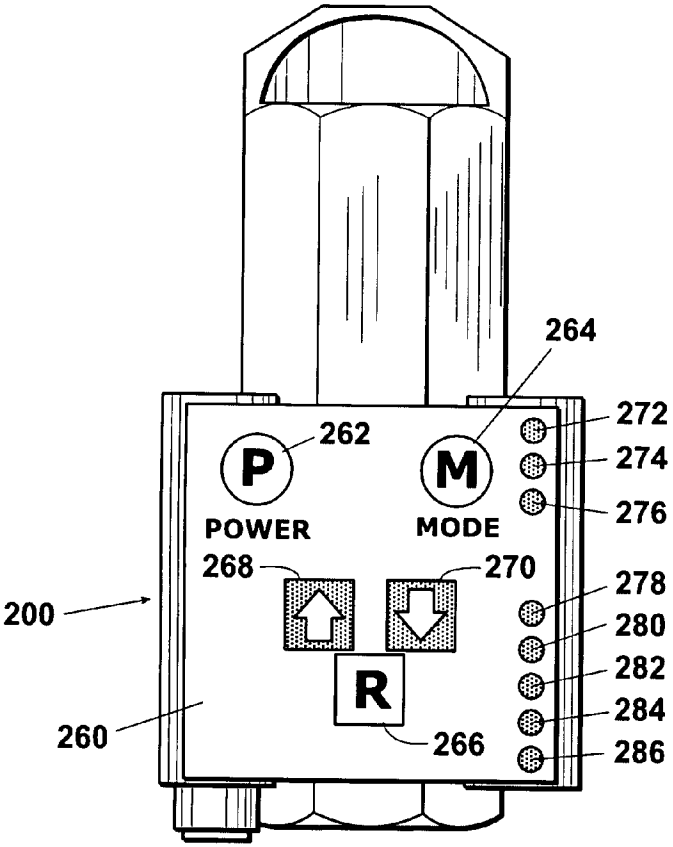
FIG. 7 is a top view of the combination red dot sight and electronic range finder as seen from section 7-7 of FIG. 6

With reference to FIG. 7, wherein is shown a preferred user interface 260 for the range finder system 200, user interface 260 includes: a power on/off button 262 for starting and stopping operation of the range finder 200; a mode push button 264 for selecting an operational mode of range finder 200; a range button 266 for initiating a range finding pulse from the range finder 200; up arrow button 268 for increasing the intensity of the red dot in the scope and down arrow button 270 for decreasing the intensity of the red dot; and a series of indicators 272-286 for indicating the various operational modes of the sight/range finder combination.

In operation, the user presses the power button one time to turn the red dot sight and range finder on. In a preferred embodiment, the range finder may include a photo sensitive detector to detect the amount of ambient light and set the intensity of the red dot emitter accordingly. Initially indicator 272 will illuminate to indicate power is on, indicator 274 will illuminate to indicate that the red dot is in auto brightness mode, and 278 will illuminate to indicate the range finder is in standard mode.

If the user presses either the up arrow 262 or the down arrow 270 the red dot intensity will increase or decrease, respectively. When the user adjusts the red dot intensity, indicator 274 will be extinguished to indicate that the sight is no longer in auto brightness mode and indicator 276 will be illuminated to indicate the sight is in manual brightness mode. In one preferred embodiment there are 20 intensity steps of the red dot, the bottom three steps being visible only with night vision goggles. Preferably the user can express to maximum brightness by depressing up arrow 268 for three seconds or to minimum brightness by depressing down arrow 270 for three seconds. Auto mode may be resumed by simultaneously pressing arrows 268 and 270 for two seconds. Indicators 274 and 276 will illuminate appropriately.

In another preferred mode of operation the condition of the battery which powers the sight may be test by depressing button 264 three times succession. Battery status indicator 286 will flash once if the battery is to 25% of its charge or less, twice if the battery is between 25% and 50% of full charge, tree times if the battery is between 50% and 75%, and four times if the battery condition is above 75% of its maximum charge.

If button 266 is depressed for three seconds, indicator 280 will illuminate to indicate that the range finder is in the scan mode. In the scan mode, the range finder generates range finding pulses in a repetitive manner and updates the display with each new pulse.

Button 264 may be depressed to change the range finder between yards and meters. Indicator 282 is illuminated to indicate that the unit of measure for the range finder display is yards and extinguished to indicate that the unit of measure for the range finder display is meters.

Button 262 may be pressed twice in succession to change the range finder to a mode where distances greater than 150 yards (or meters) may be measured. Indicator 284 is illuminated to indicate that the range finder is in such a mode. Pressing and holding button 262 will turn the power off to the sight and range finder. Alternatively, the sight and range finder will automatically turn off two hours after the last button is pressed.

Optionally, an external button may be used in lieu of button 266 to initiate ranging. This button may be connected by a cord or wirelessly, and may be hand held or attached to a gun to improve the ergonomics for a particular user.

While preferred embodiments of the present invention have been described with reference to a pulsed laser range finder, the invention is not so limited. As will be apparent to those skilled in the art, a number of range finding techniques are well known, any one of which may be appropriate for use with the present invention depending on the type of target, the range over which targeting is planned, and the resolution which the shooter desires from the range finder. By way of example and not limitation, other known range finding techniques include: ultrasonic ranging; off-axis light emission where the distance off-axis from the reflected light is representative of the distance to the target; a modulated laser where the phase angle of the modulation of the reflected light relative to the source light is indicative of the distance to the target; and the like.

Accordingly, a novel combination electronic range finding device and red dot is described.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A sighting device to assist a shooter aim at a target, comprising:

a single sighting element including a reflex type sight for projecting a light from a light source to a lens fixed in a non-rotating relationship independent of said light source such that said light is capable of being directed at the target by the shooter but is visible only in said sighting element:

a range indicator for displaying the range to the target in said single sighting element;

a body housing said sighting element, said lens and said light source for said reflex type sight and an optical display for said range indicator;

a frame proximate said body for housing a processor in electrical communication with said range indicator and said light source, wherein said range indicator is electronic and said frame further houses a range indicator circuit; and an emitting lens in optical communication with said range indicator circuit.

2. The sighting device of claim 1 further including a user interface.

3. The sighting device of claim 2 wherein said user interface includes means for varying the intensity of said light source for said reflex type sight.

4. The sighting device of claim 2 wherein said user interface includes means for activation of said processor for said range indicator.

5. The sighting device of claim 2 wherein said user interface is supported by said frame.

6. The sighting device of claim 1 further including a receiving lens in optical communication with said range indicator circuit.

7. The sighting device of claim 1 wherein said body is supported by said frame.

8. The sighting device of claim 7 wherein said frame is supported from a firearm.

9. The sighting device of claim 7 wherein said frame is supported from a bow.

10. The sighting device of claim 1 wherein said lens elements are bioptic.

11. The sighting device of claim 1 wherein an activator for said processor for said range indicator may be positioned remotely.

12. The sighting device of claim 1 wherein said activator communicates with said processor wireless transmission.

13. A sighting device to assist a shooter aim at a target, comprising:

a body housing a single sighting element;

said single sighting element including a reflex type sight for projecting a light from a light source capable of being directed at the target by the shooter visible only in said sighting element;

a range indicator circuit;

a range indicator in electrical communication with said range indicator circuit for displaying the range to the target in said single sighting element;

means for adjusting said body in response to said range to the target;

an emitting lens in optical communication with said range indicator circuit; and a receiving lens in optical communication with said range indicator circuit.

14. The sighting device of claim 13 further comprising:

a frame housing said processor in electrical communication with said range indicator circuit and said light source.

15. A sighting device to assist a shooter aim at a target, comprising:

a single sighting element including a reflex type sight for projecting a light from a light source to a lens fixed in a non-rotating relationship independent of said light source such that said light is capable of being directed at the target by the shooter but is visible only in said sighting element;

a range indicator for displaying the range to the target in said single sighting element;

a body housing said sighting element, said lens and said light source for said reflex type sight and an optical display for said range indicator;

a processor in electrical communication with said range indicator and said light source, wherein said range indicator is electronic and includes a range indicator circuit;

an emitting lens in optical communication with said range indicator circuit; and a receiving lens in optical communication with said range indicator circuit.

* * * * *